United States Patent [19]

Simons

[11] 4,398,309

[45] Aug. 16, 1983

[54] ROLLER SUPPORTED SLIDING SHOWER CADDY

[76] Inventor: Shelden M. Simons, 14110 Lemoli Ave., Hawthorne, Calif. 90250

[21] Appl. No.: 336,829

[22] Filed: Jan. 4, 1982

[51] Int. Cl.[3] ..... A47K 3/22

[52] U.S. Cl. ..... 4/605; 4/661; 4/576

[58] Field of Search ..... 4/605, 607, 661, 546, 4/576, 577

[56] References Cited

U.S. PATENT DOCUMENTS

| | | | |
|---|---|---|---|
| 2,067,591 | 1/1937 | Balmer | 4/576 |
| 3,373,448 | 3/1968 | Butler | 4/605 |
| 3,837,013 | 9/1974 | Davis et al. | 4/605 |
| 3,995,330 | 12/1976 | Meyers | 4/605 |
| 4,150,869 | 4/1979 | Hansen | 4/605 |
| 4,300,248 | 11/1981 | Dworkin | 4/576 |

*Primary Examiner*—Henry K. Artis

*Attorney, Agent, or Firm*—Beehler, Pavitt, Siegemund, Jagger & Martella

[57] ABSTRACT

A bathroom fixture such as a sliding shower caddy of a plastic material mounts to sliding doors of a shower enclosure by rubber suction cups and is supported by rollers which rest on the upper extruded aluminum support or channel guide which holds up the sliding shower doors. The fixture slides along the extrusion as the shower door to which it is attached is opened and closed to thus remove the hanging fixture from the entrance opening to facilitate entry to and exit from the shower stall or enclosed tub.

15 Claims, 4 Drawing Figures

ROLLER SUPPORTED SLIDING SHOWER CADDY

BACKGROUND OF THE INVENTION

1. Field of the Invention

This invention pertains to the field of soap dishes and related fixtures for use in bathroom shower stalls and particularly relates to a soap caddy for mounting to the sliding partition of a shower enclosure.

2. State of the Prior Art

Present shower caddies that are used to hold soap, shampoo, and other toilet or shower articles have evolved of practical necessity as the shower has come into increasing use. The need for having the shower articles at hand during stand-up showering brought the wire mesh suspended over the shower head or valve into use. This device served its purpose well, but it has some drawbacks. First, being mounted over the shower valve, it can be easily pulled off the shower head when retrieving the shower articles. Secondly, the shower spray usually wets the soap and other toilet articles. The wet soap drips and leaves a soap scum on the shower wall.

The next generation shower caddy, mounted in a corner of the stall with two-way tape, eventually separated from the wall due to the load placed on it. Even it if does not fall down, being stationary, it is difficult to clean properly, leaving a place for mold and mildew to grow. With the increased use of prefabricated single-piece fiberglass tubs and enclosures in new construction, the wall-mounted corner caddy cannot be used, due to the rounded corners.

SUMMARY OF THE INVENTION

The present invention utilizes a novel means of support and motion for shower caddies. The molded plastic caddy rests on two rollers that sit in the upper aluminum extrusion that holds up the shower doors. The rollers allow movement along the extrusion. The back of the caddy preferably comprises two rubber suction cups which attach to the inside surface of one of the shower doors. When the suction cups are attached and the rollers are resting on the extrusion the shower door and shower caddy move as one unit. When the door is opened for entry or exit, the caddy is automatically removed from the opening so as not to inconvenience the bather.

The shower caddy of this invention is supported by rollers which rest on the upper side of the aluminum extrusion which supports the sliding shower doors of a typical tub and shower enclosure. The rollers allow movement along the top of the extrusion back and forth along the length of the extrusion. One or more suction cups attach to the inside door (in the case of dual doors sliding on parallel tracks) causing the caddy to move with the inside door as a single unit.

This improves on the "over-the-shower-valve" units in several ways. First, the soap and other articles are not subject to getting wet as they will be located above and away from the mainstream of water, and away from splashing and dripping that usually occur during showering, and the dripping that occurs when the shower is turned off and water drains out of the showerhead. Second, toilet articles are not on the other side of the shower stream relative to the bather, thus allowing "dry" acquisition of the articles to be used. Third, the unit of this invention is less subject to falling off due to pulling while retrieving articles from the tray, i.e., even if the suction cups are dislodged the unit is hooked over and securely suspended from the extrusion channel guide member and cannot be pulled off—actually, to remove it, one must lift it.

The present invention also improved over the corner mounts in several aspects. One, the corner mount is attached by means of two-way tape and if too much weight is inadvertently placed on the caddy, it falls down. Two, once attached, it cannot be cleaned on its backside, or the wall area behind it cannot be cleaned, so that soap and water residues build up, creating a growth medium for mold and mildew. Three, once attached, it is difficult to remove.

DETAILED DESCRIPTION OF THE PREFERRED EMBODIMENT

Figure 1:
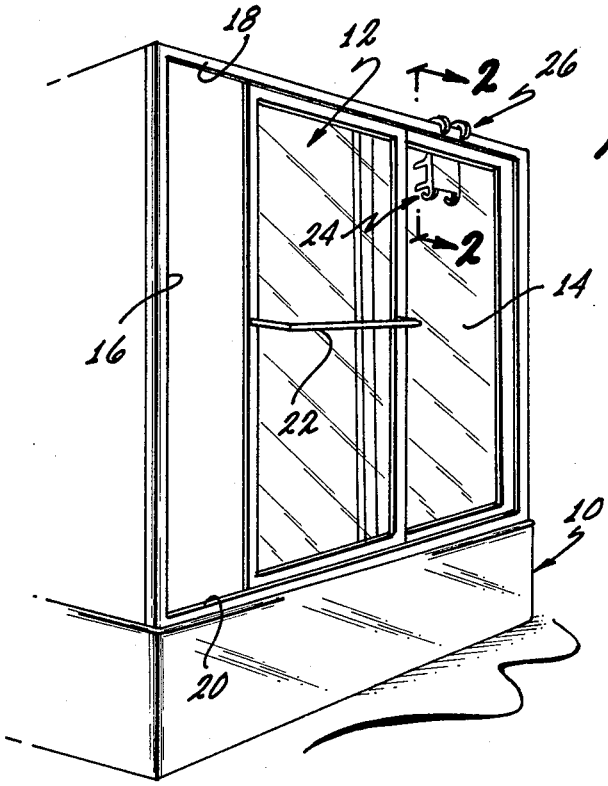
FIG. 1 shows a typical sliding door shower enclosure with the caddy of this invention installed thereon.

A preferred embodiment of the roller-supported sliding shower caddy is designated by reference numeral 24 and shown in FIG. 1 of the drawings. It comprises three vertically stacked trays, an upper portion 26, including two parallel rollers 28, and two rubber suction cups 30.

FIG. 1 shows a typical glass-enclosed shower facility which includes a tub 10 with two glass sliding door 12, 14 supported within a frame 16 between an upper extrusion 18 and a lower extrusion 20. A towel bar 22 is affixed to door 12 and aids in sliding the glass door 22 for entry into the enclosure. The rollers 28 of the preferred embodiment 24 rest on the upper extrusion 18 and attached to the glass door 14 by means of the suction cups 20.

Figure 2:
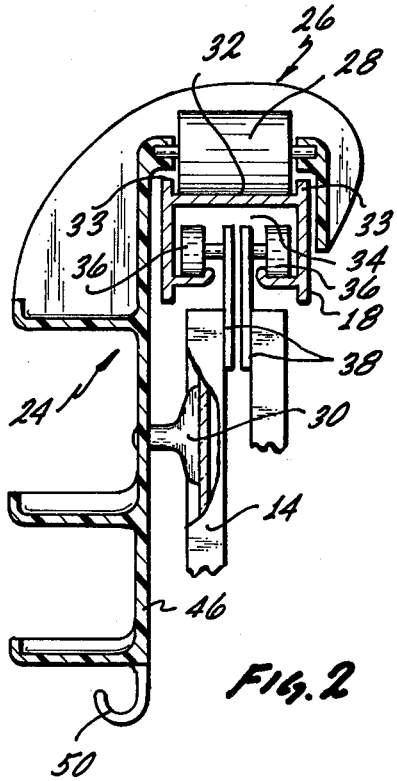
FIG. 2 is an elevational cross-sectional view taken along line 2—2 in FIG. 1, showing the upper aluminum extrusion and the sliding shower caddy mounted to the sliding door.

FIG. 2 shows details of the roller assembly as it rests in an upper channel 32 defined by the upper extrusion 18. A lower guide channel 34 in extrusion 18 supports the rollers 36 and brackets 37 from which is suspended the sliding shower door 14. The roller pins 38 retain the rollers within a roller housing 40, while allowing rolling movement along the length of the aluminum extrusion 18 within the upper channel 32 in response to sliding movement of the shower door 14 since the caddy 24 is attached to the door 14 by means of suction cups 30.

Figure 3:
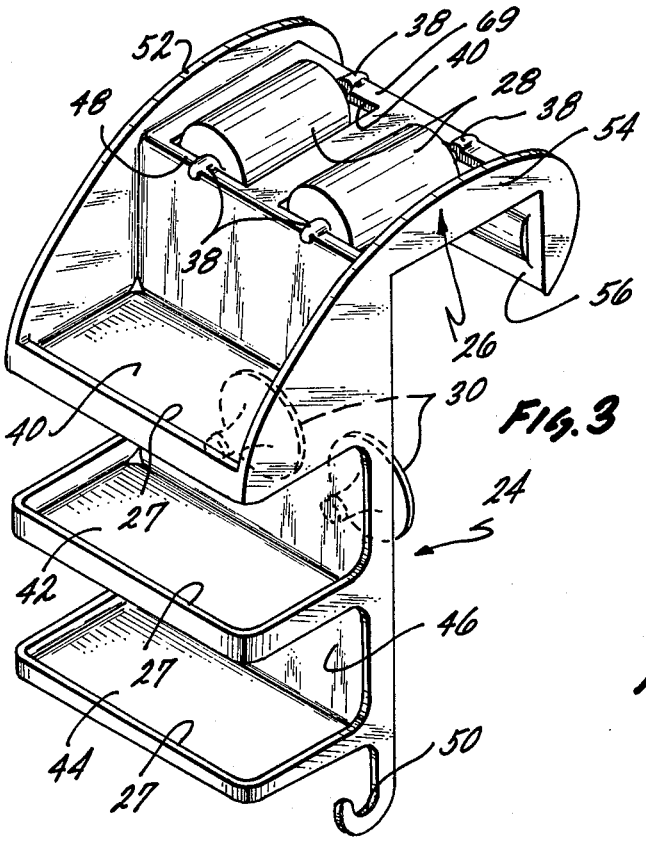
FIG. 3 is a perspective view of the sliding shower caddy showing the roller assembly; and, FIG. 4 is a rear view of the article tray assembly and elevational cross section of the roller assembly.
Figure 4:
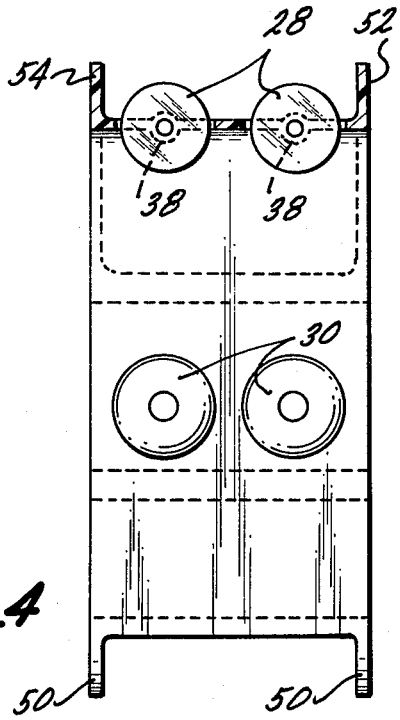

FIG. 3 shows in perspective view the roller assembly, comprising rollers 28 mounted to housing 40 by axle pins 38, the two rubber suction cups 30, and the three stacked article trays 40, 42, 44, each provided with a raised edge 27 to keep articles from falling out of the trays.

The article trays 40, 42, 44 are connected at their rear edges to a vertical planar wall 46 which terminates in an upper edge 48 and may include one or more hook members 50 at its lower edge for hanging washcloths or the like. The upper portion 26 of the caddy includes the upper edge 48 of the wall 46, a pair of transverse rib elements 52 and 54 in mutually spaced parallel relationship and connected by a short vertical wall 56 which is parallel to and spaced from the longer vertical wall 46 which supports the article trays. It is thus seen that the parallel vertical walls 46 and 56, together with parallel ribs 52 and 54, define a box housing open at the top and bottom within which are disposed the parallel rollers 28. The distance between the parallel vertical walls 46 and 56 is such as to allow the roller housing 40 to straddle the width of the upper extrusion 18 so that the lower portion of the rollers 28 may sit within the open upper channel 32 of the extrusion 18 and carry the weight of the caddy and any articles thereon to thus minimize friction with the extrusion during sliding displacement. Preferably, the width of the rollers 28 is slightly less than the width of the upper channel 32 formed between the vertical side walls 33 of the extrusion 18 such that the two tandem rollers 28 will maintain the fixture 24 in alignment with the extrusion and the door to prevent the fixture 24 from wobbling or becoming skewed during movement. The stability of the caddy during the sliding displacement is aided by using two laterally-spaced suction cups 30 to further stabilize the fixture. The axle pins 38 of the rollers are secured as by gluing within notches formed in the upper edges 48 and 49 of the parallel vertical walls 46 and 56, or by other suitable means.

It will be understood that the fixture of this invention may be mounted to the upper extrusion 18 for sliding movement without use of rollers 28. For example, a leaf spring element formed of a suitably shaped length of sheet metal and dimensioned to slide within the upper channel 32 could be substituted for the rollers 38 to simplify the structure and reduce costs. Similarly, the suction cups 30 may be substituted by other adhesive elements, and the invention is therefore not restricted to the particular roller means and suction cup structures shown and described. It is the essence of the invention that the weight of the fixture be supported by the upper extrusion 18 while the fixture is attached to the sliding door 14 so that it is transported therewith along the extrusion when the door is moved for entry or exit into the shower enclosure.

While a preferred embodiment of the invention has been shown and illustrated, it will be understood that various changes, substitutions and modifications are possible without departing from the spirit and scope of the invention. Therefore, applicant intends to be bound only by the scope of the following claims.

What is claimed is:

1. A fixture useful for supporting toilet articles or the like for installation in a shower enclosure of the type including a sliding partition and an upper extrusion for supporting the partition, said fixture comprising:

an upper portion dimensioned to straddle said upper extrusion for sliding movement therealong;

one or more article trays supported by said upper portion; and, means for securing said fixture to said slidable partition whereby said fixture is suspended form said upper extrusion and is slidable therealong responsive to movement of said partition.

2. The fixture of claim 1 further comprising roller means mounted to said upper portion of said fixture in axially transverse relationship to said upper extrusion for rolling displacement along said upper extrusion responsive to sliding movement of said partition.

3. The fixture of claim 1 or claim 2 wherein said means for securing comprise one or more suction cups.

4. The fixture of claim 1 or claim 2 wherein said upper portion comprises a pair of parallel vertical walls spaced for straddling said upper extrusion.

5. The fixture of claim 4 wherein said roller means are disposed transversely between said parallel vertical walls.

6. The fixture of claim 5 wherein one of said vertical walls extends downwardly from said upper portion and has one or more article trays attached thereto.

7. The fixture of claim 6 wherein said article trays are stacked vertically along said one vertical wall.

8. The fixture of claim 6 wherein said means for securing are attached to the side of said one vertical wall which faces the other of said vertical walls.

9. The fixture of claim 8 wherein said means for securing comprise one or more suction cups.

10. The fixture of claim 8 wherein said means for securing comprise a pair of laterally spaced suction cups.

11. The fixture of claim 2 wherein said roller means comprise two axially parallel rollers.

12. A fixture useful for supporting toilet articles and the like for installation in a shower enclosure of the type including a sliding partition and an upper extrusion for supporting the partition, said fixture comprising:

an upper portion including a roller housing defined by a pair of spaced parallel vertical walls and a pair of transverse rib members to define an enclosure open at the bottom;

one or more article trays supported by one of said vertical walls;

one or more rollers disposed transversely within said roller housing between said vertical walls for rolling displacement along said upper extrusion;

one or more suction cups attached to said vertical wall on the side opposite said article trays for securing said fixture to said slidable shower partition whereby the weight of said fixture and articles placed on said trays is supported by said upper extrusion, said fixture being slidable along said extrusion responsive to movement of said sliding partition.

13. The fixture of claim 12 wherein said fixture comprises two parallel rollers within said roller housing.

14. The fixture of claim 12 or claim 13 wherein said fixture comprises two laterally spaced suction cups.

15. A fixture useful for supporting toilet articles or the like for installation in a shower enclosure of the type including a sliding partition and an upper extrusion for supporting the partition, said fixture comprising:

an upper portion dependable from said upper extrusion for sliding movement therealong;

article support means attached to said upper portion; and, means for securing said fixture to said slidable partition whereby said fixture is suspended from said upper extrusion and is slidable therealong responsive to movement of said partition.

* * * * *